United States Patent [19]

Pantaleo et al.

[11] Patent Number: 4,941,590

[45] Date of Patent: Jul. 17, 1990

[54] WATER-FILLED GLASS TOY

[76] Inventors: Terese A. Pantaleo, 7854 Redondo La., Orland Park, Ill. 60462; Donald E. Perrin, 255 N. 6th St., Clinton, Iowa 52732

[21] Appl. No.: 367,380

[22] Filed: Jun. 16, 1989

[51] Int. Cl.[5] ..... B65D 65/00

[52] U.S. Cl. ..... 220/428; 206/217

[58] Field of Search ..... 220/428, 427, 426; 206/217

[56] References Cited

U.S. PATENT DOCUMENTS

| | | | |
|---|---|---|---|
| 2,353,383 | 7/1944 | Bartsch | 220/427 |
| 2,526,165 | 10/1950 | Smith | 220/428 |
| 2,544,824 | 3/1951 | Clifford | 220/428 |
| 3,069,043 | 12/1962 | Bishop | 220/428 |
| 3,429,369 | 2/1969 | Segal | 220/428 |

*Primary Examiner*—Joseph Man-Fu Moy

*Attorney, Agent, or Firm*—Wallenstein, Wagner & Hattis, Ltd.

[57] ABSTRACT

The present invention is an article of manufacture comprising an inner surface, an outer, generally visually transparent surface, and a generally annular space between and defined by the inner and outer surfaces. The annular space contains a liquid. One or more generally flat disks are provided within the annular space, and the disk or disks floats upon the liquid. A plurality of fins within the annular space imparts turbulence to the liquid and propels the disks as the article is rotated about its axis.

6 Claims, 1 Drawing Sheet

WATER-FILLED GLASS TOY

TECHNICAL FIELD

This invention relates generally to an article of manufacture, and more particularly to glass or plastic liquid containers that may also be used as a game or toy. These containers are especially suitable for the amusement and the distraction of children dining at restaurants with their parents.

BACKGROUND OF THE INVENTION

Young children have a generally short attention span. For this reason, children generally become fidgety and restless when made to sit in one place for extended periods of time. As a result, family trips to restaurants and other similar establishments can be difficult.

Usually, restaurants catering to families strive to provide some sort of amusement or distraction for the children. One such distractions is often embodied in the placemats used for adorning and protecting restaurant tables. As one example, restaurants may have disposable paper placemats that embody various types of games, puzzles, or riddles to keep children occupied before, during, and after meals. Children typically use pencils or other markers to write directly on the placemats to play these games, or solve the puzzles or riddles.

A further advance on this art is described in U.S. Pat. No. 4,738,888, issued on Apr. 19, 1988, to the co-inventors of the present invention. The invention described in the '888 patent is a reusable serving mat which includes a pair of superimposed sheets, typically made of plastic, and sealed to each other to define a chamber containing a free flowing liquid medium. A plurality of discrete articles or game pieces suspended in this liquid medium are movable by manipulation of the liquid medium within the chamber.

SUMMARY OF THE INVENTION

According to the present invention, a drinking glass or similar article of manufacture has been developed that is reusable and which contains movable objects.

The article can be utilized for amusement during idle times in a restaurant, at a kitchen table, or at any other appropriate time or place.

More specifically, the device consists of a drinking glass or other similar article that includes an inner surface, an outer generally transparent surface, and a generally annular space between and defined by the inner and outer surfaces.

The annular space contains a liquid. One or more generally flat disks are placed within the annular space and float upon the liquid. Both the liquid and the generally flat disks are sealed within the annular space.

Means are provided within the annular space for imparting turbulence to the liquid as the article is rotated about its axis. In a most preferred embodiment of the invention, the means for imparting turbulence to the liquid comprises a plurality of fins.

As turbulence is imparted to the liquid by the fins through the rotation of the article about its axis, one or more generally flat disks within the annular space and floating upon the liquid are propelled forward are moved forward by the turbulent liquid.

For example, if the flat disk is made to appear like a racing car, and if graphics on the outer surface of the article are made to appear like the borders of a roadway, then rotation of the article about its axis gives the impression that the auto is moving along a roadway.

By providing the article with a plurality of generally flat disks, several cars can move simultaneously along the roadway and the user can simulate a race between these cars.

In yet another preferred embodiment of the invention, the liquid is placed into the annular space through an opening in the article's outer surface.

DETAILED DESCRIPTION OF THE PREFERRED EMBODIMENT

Figure 1:
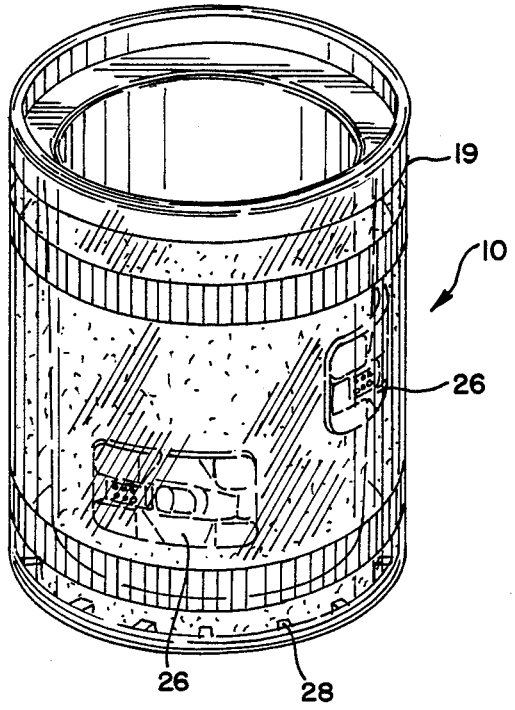
FIG. 1 is a perspective view of a drinking glass which comprises an article in accordance with the invention.

While this invention is susceptible of embodiment in many different forms, there is shown in the drawings and will herein be described in detail a preferred embodiment of the invention. It should be understood, however, that the present disclosure is to be considered an exemplification of the principles of the invention. It is not intended to limit the broad aspect of the invention to the embodiment illustrated.

FIG. 1 of the drawings discloses a perspective view of an article of manufacture in accordance with the invention. In this embodiment, this article comprises a drinking glass 10.

Figure 2:
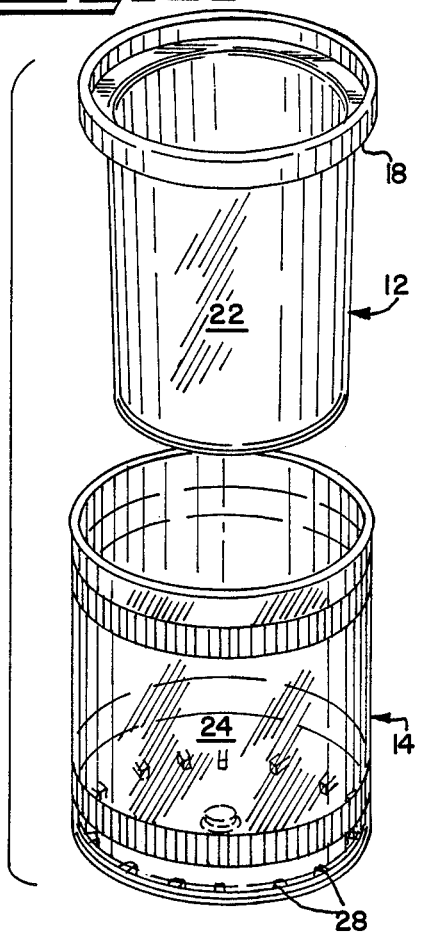
FIG. 2 is an exploded view of the drinking glass shown in FIG. 1.

As may be best appreciated from FIG. 2, the present drinking glass is formed from a composite of two (2) generally drinking glass-shaped cup elements, 12 and 14, respectively.

Each of these cup elements 12 and 14 are of a similar, conventional cup shape. In the preferred embodiment, these cups are formed by conventional blow molding techniques using an acrylic or other similar transparent, thermoplastic material.

Cup elements 12 and 14 are formed to be nestable, one within the other. As the diameter of cup element 12 is smaller than that of cup 14, cup 12 nests within cup 14 in the manner shown in FIG. 3. The surface of an upper peripheral rim 16 of cup 14 closely coincides with the surface of a lower lip 18 of cup 12. In this manner, a sonic or other weld-type seal 19 (FIG. 1) between the upper peripheral rim 16 and the lower lip 18 can be made. This seal 19 is water-tight.

Figure 3:
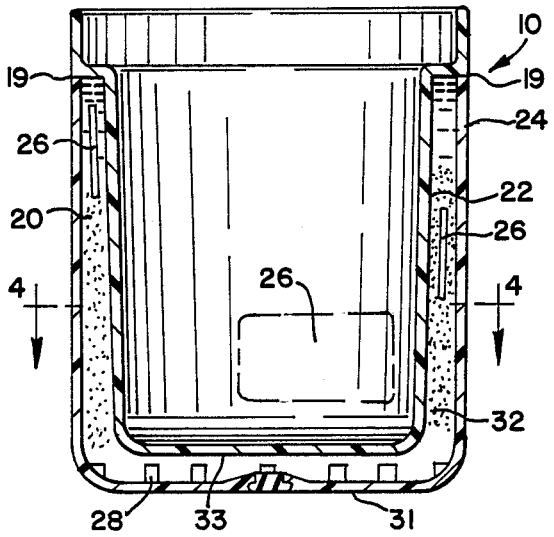
FIG. 3 is a side view of the drinking glass shown in FIG. 1, and showing the fins within the annular space of the drinking glass, the fins provided for imparting turbulence to the liquid within that annular space.
Figure 4:
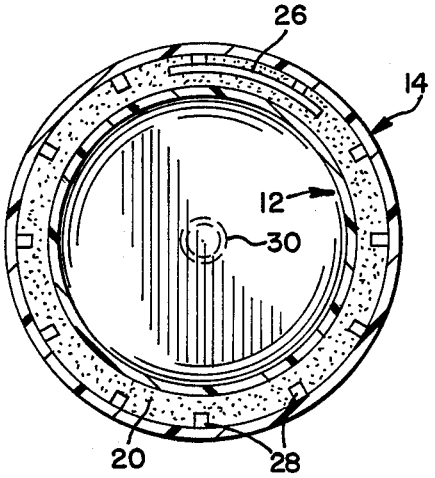
FIG. 4 is a sectional view, taken along lines 4—4 of FIG. 3, of the drinking glass of FIG. 3.

As may be seen in FIG. 3, the nesting of cups 12 and 14 forms a generally annular space 20 in the drinking glass or article 10 defined by the sides of those cups. In particular, the side of cup 12 forms the inner surface 22 of drinking glass 10. The side of cup 14 forms an outer, generally visually transparent surface 24 of drinking glass 10.

Prior to sonically sealing the upper peripheral rim 16 with the lower lip 18, one or more generally flat disks 26 are placed in the annular space formed by cups 12 and 14. These disks 26 are generally but not precisely flat, as they preferably have a slight convex shape. The convex shape enables those disks 26 to move more easily through the water or other suitable liquid when the glass is rotated about its axis, as will be explained below.

When the cups are nested together and sonically sealed, the disks 26 are permanently contained within the annular space 20. These generally flat disks 26 are lighter than and thus are buoyed and float upon the liquid that is inserted within the annular space.

Means are provided within the annular space 20 for imparting turbulence to that water or other liquid as the article or drinking glass 10 is rotated about its axis. In this embodiment, these means for imparting turbulence comprise a plurality of fins 28 integrally molded into the base of cup 14. These fins 28 are radially spaced along the base 31 of cup 14.

In yet another embodiment, rows of these fins 28 may be "stacked" upon one another. In this configuration, discrete fins may be molded into and start near the top of inner wall of cup 14 and descend, with vertical spacing between each of those fins. In still another embodiment, these fins 28 may be randomly placed along the inner wall of this cup 14. In fact, any arbitrarily chosen fin configuration which imparts a suitable turbulence to the liquid within the annular space 20 is acceptable.

A clear, transparent non-toxic liquid such as water is introduced into the annular space 20 through an opening in the outer surface of the glass 10. In this embodiment, this opening 30 is in the center of the base 31 of cup 14.

Due to the construction of the present embodiment with its nestable cups 12 and 14, their respective bases 31 and 33 are spaced apart from each other (FIG. 3). Thus, liquid inserted into the annular space 20 through opening 30 also remains in the space between bases 31 and 33 of cups 14 and 12.

After water is placed into the annular space 20 through opening 30, a plug (not shown) is inserted to seal that opening. In this embodiment, the plug may include an appropriately shaped acrylic piece which is sonically welded to the base 31 of cup 14. In this manner, water will not leak out of the drinking glass 10 during use.

As may be seen in FIG. 1, the outer, generally visually transparent surface 24 of the drinking glass 10 can include graphics. In the present embodiment, these graphics give the outer surface 24 of drinking glass 10 the appearance of a roadway or raceway. As the glass is rotated about its axis, the fins 28 impart turbulence to the water within the annular space 20. The turbulent water dynamically propels the disks 26 forward and circumferentially around the glass 10 and within its annular space 20. In this embodiment, these disks 26 have the appearance of racing cars. Thus, the user can be amused by the several cars in an apparent race.

Disks bearing alternate graphics, for example, disks simulating airplanes, trains, and other interesting objects, may be substituted for the disks bearing autos and described in the present embodiment. The outer surface 24 of glass 10 may also be provided with graphics suitable to these various alternate objects.

In yet another embodiment, glitter 32 may be inserted through the opening 30 at the same time that water is introduced into the annular space 20. The glitter 32 in the annular space 20 will be scattered as the disks 26 move through the water, creating a generally pleasing affect.

While specific embodiments have been illustrated and described, numerous modifications come to mind without significantly departing from the spirit of the invention. Accordingly, the scope of protection is only limited by the scope of the accompanying claims.

What I claim is:

1. An article of manufacture comprising:

(a) an inner surface;

(b) an outer, generally visually transparent surface;

(c) a generally annular space between and defined by said inner and outer surfaces, said annular space containing a liquid;

(d) a generally flat disk within said annular space and floating upon said liquid; and, (e) means within said annular space for imparting turbulence to said liquid as said article is rotated about its axis.

2. The article as set forth in claim 1, wherein said means for imparting turbulence comprises a plurality of fins.

3. The article as set forth in claim 1, wherein said liquid is placed within said annular space through an opening in said outer surface.

4. An article of manufacture comprising:

(a) an inner surface;

(b) an outer, generally visually transparent surface with an opening therein;

(c) a generally annular space between and defined by said inner and outer surfaces, said annular space containing a liquid that is placed within said annular space through said opening;

(d) a generally flat disk within said annular space and floating upon said liquid; and, (e) a plurality of fins within said annular space for imparting turbulence to said liquid and propelling said disks as said article is rotated about its axis.

5. A drinking glass, comprising:

(a) an inner surface;

(b) an outer, generally visually transparent surface;

(c) a generally annular space between and defined by said inner and outer surfaces, said annular space containing a liquid that is placed within said annular space;

(d) a generally flat disk within said annular space and floating upon said liquid; and, (e) a plurality of fins within said annular space for imparting turbulence to said liquid and propelling said disks as said drinking glass is rotated about its axis.

6. The drinking glass as set forth in claim 5, further comprising an opening in said outer surface for insertion of said liquid within said annular space.

* * * * *